United States Patent [19]

Gartner

[11] Patent Number: 4,531,336

[45] Date of Patent: Jul. 30, 1985

[54] MULLION PORTION IN A UNIT TYPE CURTAIN WALL

[75] Inventor: Karl Gartner, Gundelfingen, Fed. Rep. of Germany

[73] Assignee: Yoshida Kogyo K.K., Tokyo, Japan

[21] Appl. No.: 519,201

[22] Filed: Aug. 1, 1983

[30] Foreign Application Priority Data

Aug. 10, 1982 [JP] Japan ..... 57-121496

[51] Int. Cl.[3] ..... E06B 7/14

[52] U.S. Cl. ..... 52/209; 52/235; 49/DIG. 1

[58] Field of Search ..... 52/235, 777, 476, 781, 52/403, 209; 49/DIG. 1

[56] References Cited

U.S. PATENT DOCUMENTS 4,276,729 7/1981 Shiga et al. ..... 52/209

*Primary Examiner*—Carl D. Friedman

*Attorney, Agent, or Firm*—Hill, Van Santen, Steadman & Simpson

[57] ABSTRACT

A unit type curtain wall assembly has an array of standardized curtain wall units each having a passageway for air and another passageway for hot or cold water extending through its frame members for room temperature control. For sealing a gap between the opposed side frame members of every two horizontally adjoining curtain wall units so as to minimize the loss of heat energy, an indoor sealing band and a first outdoor sealing band are connected between the opposed side frame members to close the indoor and outdoor sides of the gap therebetween. A second outdoor sealing band is connected exteriorly of the first outdoor sealing band to provide another closed space therebetween so as to prevent heat transmission from the outside. The three sealing bands with the two intervening closed spaces constitute in combination an effective heat insulator. The sealing bands are engaged with the side frame members so as to allow the relative displacement of the curtain wall units in their own plane.

5 Claims, 2 Drawing Figures

MULLION PORTION IN A UNIT TYPE CURTAIN WALL

BACKGROUND OF THE INVENTION

This invention relates to a unit type curtain wall assembly comprising an array of standardized curtain wall units, and more specifically to such an assembly with provisions for the year-round temperature control or air conditioning of rooms. Still more specifically the invention pertains to means in such a unit type curtain wall assembly for sealing the gaps (mullion portions) between the horizontally neighboring ones of the curtain wall units.

Japanese Patent Application No. 57-133764, filed by the same applicant as in the present application, proposes a prefabricated curtain wall system with a built-in temperature control function. According to this system disclosed in the separate application, the vertical and horizontal frame members of the standardized curtain wall units have formed therethrough a passageway for air and another passageway for a heat transfer fluid such as cold or hot water. The heat transfer fluid gives heat the air flowing through the air passage or takes away from the air. Thus, the cool or warm air is expelled into the rooms through vents in some of the horizontal frame members.

This type of unit type curtin wall assembly with the room temperature control system has had a problem in connection with the heat insulation of the joints or seams between horizontally adjoining curtain wall units. Namely, in order to absorb displacements of the curtain wall units caused by the outside force such as, for example, earthquake, gale, etc., the opposed vertical side frame members of every two horizontally adjoining curtain wall units are slightly spaced from each other to admit of the relative displacement of the curtain wall units in their own plane. Should these vertical gaps (mullion portions) between the curtain wall units be left open, the indoor and outdoor sides of the unit type curtain wall assembly would intercommunicate therethrough with each other, to the detriment of its room temperature control capability. Further the heat energy of the fluid flowing through the side frame members of the curtain wall units would partly escape through the gaps (mullion portions) and so would not be fully utilized for room temperature control.

SUMMARY OF THE INVENTION

The present invention seeks to prevent the escape of heat energy through the gaps (mullion portions) between horizontally adjoining curtain wall units in a unit type curtain wall assembly of the class defined and hence to make utmost use of the energy for room temperature control or air conditioning. with attaining this objective, moreover, the invention pays due consideration to the desired relative displacement of the individual curtain wall units in their own plane.

Basically the invention is directed to an assembly of standardized curtain wall units each having a pair of side frame members, with at least one fluid passageway extending longitudinally through each side frame member. The curtain wall units are assembled to steel frames with a predetermined gap (mullion portion) between the opposed side frame members of every two horizontally neighboring units. According to the invention an indoor sealing band and a first outdoor sealing band are connected between each opposed pair of side frame members to close the gap (mullion portion) therebetween on the indoor and outdoor sides thereof. A second outdoor sealing band is likewise connected exteriorly of the first outdoor sealing band to provide another closed space therebetween.

Thus, in accordance with the invention, the gap (mullion portion) between every two horizontally adjoining curtain wall units is closed by the three sealing bands with the two intervening closed spaces, which serve in combination an effective heat barrier between the indoor and outdoor sides of the unit type curtain wall assembly. The conditioned indoor air is therefore not to escape through the gap (mullion portion).

As the gap (mullion portion) between every two horizontally adjoining curtain wall units is closed by the indoor sealing band and first outdoor sealing band as above, the heat energy that has transferred from the side frame members into this closed gap can be conserved therein, resulting in a decrease in temperature difference between the side frame members and the closed gap. The closed gap is further insulated from the outdoors by the additional closed space defined between the first and second outdoor sealing bands. Accordingly, the loss of the heat energy through the gap (mullion portion) is reduced to an absolute minimum and, at the same time, the additional closed space forms a heat insulating layer with respect to variation of an outdoor temperature.

According to a further feature of the invention the indoor sealing band and first outdoor sealing band are both mounted by having their lateral marginal portions engaged in respective pairs of opposed grooves defined in the side frame members of the curtain wall units. The second outdoor sealing band is likewise mounted by having its lateral marginal portions engaged in a pair of opposed grooves in retainer strips which are secured to the side frame members via heat insulating connector means. Thus interconnected between the side frame members, the three sealing bands can follow up the desired relative displacement of the curtain wall units in their own plane.

The above and other features and advantages of this invention and the manner of attaining them will become more apparent, and the invention itself will best be understood, from a study of the following description and appended claims, with reference had to the attached drawings showing an exemplary embodiment of the invention.

DESCRIPTION OF THE PREFERRED EMBODIMENT

Figure 1:
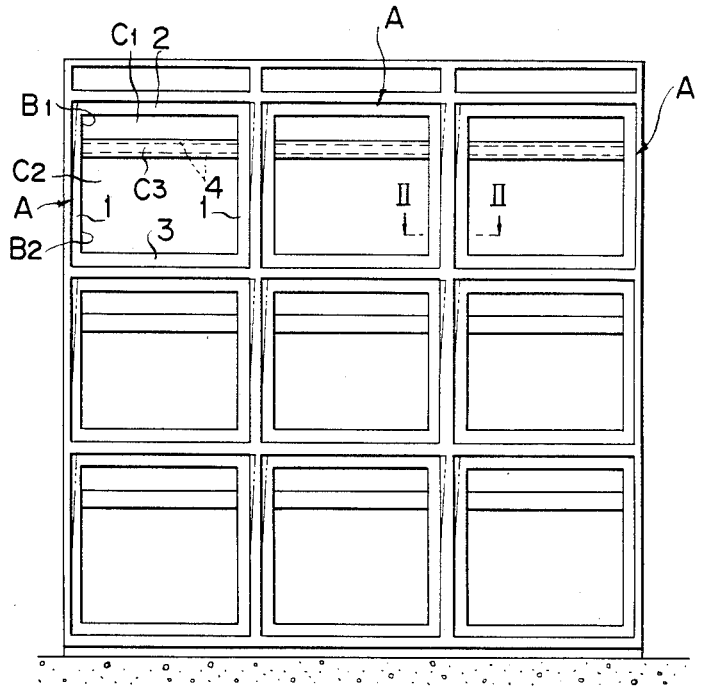
FIG. 1 is an elevation of a preferred form of the unit type curtain wall assembly constructed in accordance with the principles of the invention.

The exemplified unit type curtain wall assembly of FIG. 1 comprises a plurality of standardized curtain wall units A arrayed in rows and columns. Each curtain wall unit A has a pair of vertical side frame members 1, a horizontal top frame member 2, and a horizontal bottom frame member 3, which are combined into a rectangular shape. Each curtain wall unit A further comprises a pair of intermediate frame members 4 extending horizontally between the pair of side frame members 1.

Thus the rectangular opening bounded by the side, top and bottom frame members 1, 2 and 3 of each curtain wall unit is divided by the intermediate frame members 4 into an upper opening B1 and a lower opening B2. These openings are closed by panels or panes C1 and C2 of double glazing or other suitable material having a heat insulating property. Another panel C3 of any desired material having also a heat insulating property is fitted between the pair of intermediate frame members 4.

Figure 2:
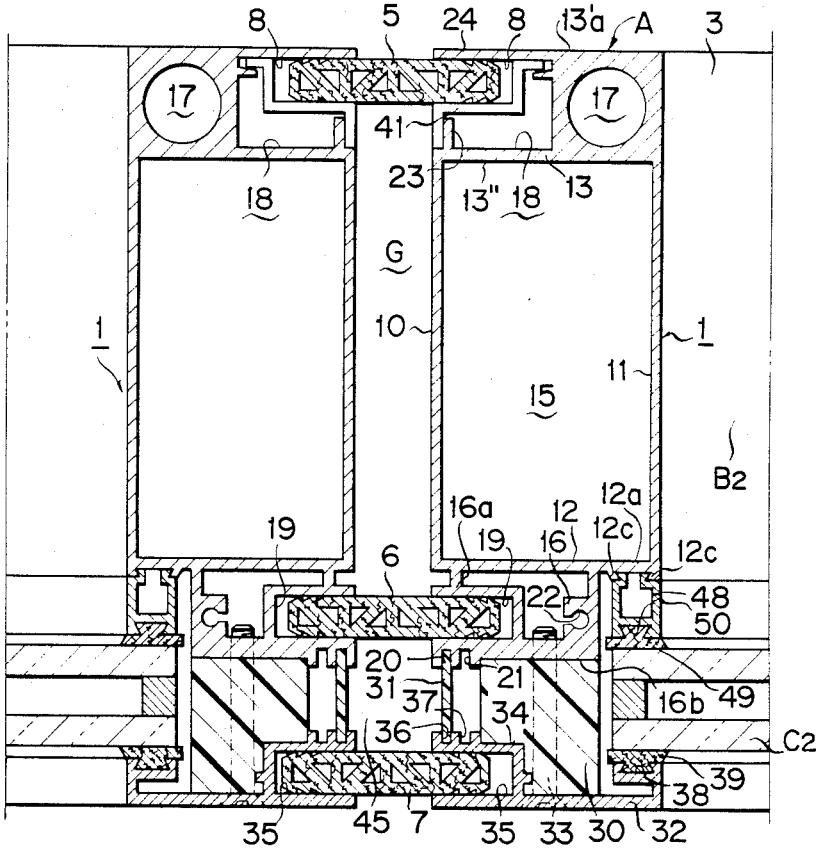
FIG. 2 is an enlarged, fragmentary horizontal section through the unit type curtain wall assembly of FIG. 1, taken along the line II—II therein and showing in detail the means for closing the gap between every two horizontally adjoining curtain wall units in accordance with the invention.

Reference is now directed to FIG. 2 in order to describe the invention in more specific terms. Shown in this figure are the opposed side frame members 1 of any two horizontally neighboring curtain wall units A, together with three sealing bands 5, 6 and 7 closing the gap (a mullion portion, but hereinafter represents merely as "gap") G between the side frame members. The topmost sealing band 5 faces indoors, and the lowermost sealing band 7 outdoors. The sealing bands 5, 6 and 7 are made of a resilient material such as, for example, a synthetic rubber and each having such a shape as having therewithin reinforcement portions formed in a truss which divide an inner hollow portion into plural chambers. The sealing band 5 will therefore be referred to as the indoor sealing band, the sealing band 6 as the first outdoor sealing band, and the sealing band 7 as the second outdoor sealing band.

Each side frame member 1 is hollow and substantially rectangular in cross sectional shape. It has a pair of side walls 10 and 11, an exterior end wall 12, and an interior end wall 13, defining in combination a first passageway 15 of rectangular cross section for the flow of conditioning air.

The interior end wall 13 of each side frame member 1 is made thicker than the other walls 10, 11 and 12 and has formed longitudinally therethrough a second passageway 17 of circular cross section through which there flows a heat transfer medium such as hot or cold water. The second passageway 17 is located closer to one side of the interior end wall 13, away from the side frame member 1 of the neighboring curtain wall unit A, to make room for a recess 18 also formed in the interior end wall 13. Thus, cross-sectionally, the first passageway 15 occupies a major portion of each side frame member 1, and the second passageway 17 lies interiorly of the first passageway in side-by-side relation to the recess 18.

The recess 18 is bounded in part by a flange 23 projecting interiorly from the thin portion 13″ of the interior end wall 13 and by another flange 24 formed in coplanar relation to the indoor sur face 13′*a* of the interior end wall 13. These flanges 23 and 24 are arranged to leave the recess 18 open to the gap G between the two opposed side frame members 1.

Fixedly mounted in the recess 18 is a substantially W-shaped mounting member or members 41 which define in combination with the flange 24 a mounting groove 8 open to the gap G between the opposed side frame members 1. The aforesaid indoor sealing band 5 is connected between the opposed side frame members 1 by having its lateral marginal portions engaged in the pair of opposed mounting grooves 8 formed therein. Thus the indoor sealing band 5 closes the gap G on its indoor side.

The exteior end wall 12 of each side frame member 1, on the other hand, has a mount 16 formed integral therewith and generally projecting exteriorly therefrom. The mount 16 is of hollow construction, including a side wall 16*a*, an end wall 16*b*, and another side wall 16*c*. Between side wall 16*a* and end wall 16*b* there is defined another mounting groove 19 open to the gap G between the side frame members 1.

The noted first outdoor sealing band 6 is connected between the opposed side frame members 1 by having its lateral marginal portions engaged in the pair of opposed mounting grooves 19 formed therein. this first outdoor sealing band closes the outdoor side of the gap G.

Also defined in the end wall 16*b* of the mount 16 are two mounting grooves 20 and 21 which are both open exteriorly of the unit type curtain wall assembly. The junction of the end wall 16*b* and side wall 16*c* is thickened inwardly to provide a screw hole 22. The exterior end wall 12 of the side frame member 1 has a portion 12*a* left exposed by the mount 16. This exposed portion 12*a* of the exterior end wall has a pair of parallel spaced ridges 12*c* defining an undercut groove for a purpose yet to be described.

A retainer strip 32 is secured as by countersunk screws 33 to the end wall 16*b* of the mount 16 of each side frame member 1 via connectors 30 and 31 of thermal insulating material. The retainer strip 32 has an L-shaped flange 34 directed interiorly therefrom and having formed therein two mounting grooves 36 and 37 opposed to the mounting grooves 20 and 21 in the end wall 16*b* of the mount 16. The heat insulating connector 30 is of approximately square shaped cross section, recessed along one corner for engagement with the L-shaped flange 34. The other heat insulating connector 31 takes the form of a thin strip having its opposite marginal edge portions snugly fitted in the mounting groove 20 in the mount 16 and in the mounting groove 36 in the L-shaped flange 34.

The retainer strip 32 coacts with the L-shaped flange 34 to define a mounting groove 35 opposed to the other similar mounting groove 35 associated with the adjoining side frame member 1. The aforementioned second outdoor sealing band 7 has its lateral marginal portions engaged in the pair of opposed mounting grooves 35. Lying exteriorly of the first outdoor sealing band 6, the second outdoor sealing band 7 bounds the exterior end of a space 45 which is closed at its interior end by the first outdoor sealing band 6 and on either side by the two heat insulating connectors 30 and 31.

FIG. 2 is further illustrative of the way in which each pane of double glazing C2 is peripherally supported by each side frame member 1. The supporting means include an exterior sealing strip 39 engaged in an undercut groove 38 defined by the retainer strip 32 and held against the exterior face of the double glazing C2. An interior sealing strip 49, held against the interior face of the double glazing C2, is engaged in an undercut groove 50 in a spacer 48 which in turn is engaged between the pair of parallel spaced ridges 12*c* on the exterior end wall 12 of the side frame member 1.

As has been fully described in the foregoing, the gap G between every two horizontally adjoining curtain wall units A is closed by the indoor sealing band 5 on the one hand and, on the other, by the first and second outdoor sealing bands 6 and 7 with the closed space 45 therebetween. The combination of the three sealing bands with the two intervening closed spaces constitutes the optimum means for preventing heat flow in either direction through the gap and preventing heat flow from the outside. The three sealing bands 5, 6 and 7, moreover, are mounted in place by having their opposite marginal edge portions engaged in the three pairs of opposed mounting grooves 8, 19 and 35 in the side frame members 1 and the retainer strips 32. Thus, despite the positive sealing of the gap G against heat transfer, the individual curtain wall units A are displaceable with respect to each other in their own plane.

It is to be understood that the unit type curtain wall assembly disclosed herein to exemplify the present invention has been selected with the thought of pictorially presenting one possible application of the gap sealing means in conjunction with the resulting advantages. A variety of changes may be made in the form, details, arrangements, and proportions of the parts without departing from the spirit or scope of the invention as expressed in the following claims.

What is claimed is:

1. A unit type curtain wall assembly composed of a plurality of standardized curtain wall units, each curtain wall unit having a top and a bottom frame members and a pair of side frame members joined into a rectangular shape, with at least one fluid passageway extending longitudinally through each frame member, there being a gap between the opposed side frame members of every two horizontally adjoining curtain wall units, wherein the improvement comprises:

(a) an indoor sealing band connected between the opposed side frame members of every two horizontally adjoining curtain wall units to close the gap to flow therebetween on the indoor side thereof;

(b) a first outdoor sealing band connected between the opposed side frame members of every two horizontally adjoining curtain wall units to close the gap to flow therebetween on the outdoor side thereof; and (c) a second outdoor sealing band connected substantially between the opposed side frame members of every two horizontally adjoining curtain wall units and disposed exteriorly of the first outdoor sealing band to provide a space closed to flow between the first and second outdoor sealing bands.

2. The unit type curtain wall assembly of claim 1 wherein the opposed side frame members of every two horizontally adjoining curtain wall units define two pairs of opposed grooves for engaging the indoor sealing band and the first outdoor sealing band respectively, and wherein the curtain wall assembly further comprises:

(a) heat insulating connector means on the outdoor side of each side frame member; and (b) a retainer strip secured to each side frame member via the heat insulating connector means, the retainer strips on the opposed side frame members of every two horizontally adjoining curtain wall units defining a pair of opposed grooves for engaging the second outdoor sealing band.

3. The unit type curtain wall assembly of claim 2 wherein a closed space formed between the said indoor sealing band and the said first outdoor sealing band is so disposed in parallel to the said fluid passageway as to be in side-by-side relation thereto, and the said closed space formed between the said first and second outdoor sealing bands is so disposed in parallel to the heat insulating connector means as to be in side-by-side relation thereto.

4. A unit type curtain wall assembly capable of room temperature control, comprising:

(a) an array of standardized curtain wall units of rectangular shape, each curtain wall unit including a pair of side frame members each having formed therethrough a first passageway for one temperature control fluid and a second passageway for another temperature control fluid;

(b) there being a gap between the opposed side frame members of every two horizontally adjoining curtain wall units;

(c) an indoor sealing band closing the gap between the opposed side frame members of every two horizontally adjoining curtain wall units on the indoor side thereof by being engaged in a first pair of opposed grooves in the side frame members;

(d) a first outdoor sealing band closing the gap between the opposed side frame members of every two horizontally adjoining curtain wall units on the outdoor side thereof by being engaged in a second pair of opposed grooves in the side frame members;

(e) heat insulating connector means on the outdoor side of each side frame member;

(f) a retainer strip secured to each side frame member via the heat insulating connector means, the retainer strips on the opposed side frame members of every two horizontally adjoining curtain wall units defining a third pair of opposed grooves; and (g) a second outdoor sealing band engaged in the third pair of opposed grooves and disposed exteriorly of the first outdoor sealing band to provide a closed space between the first and second outdoor sealing bands.

5. The unit type curtain wall assembly of claim 4 wherein the first passageway in each side frame member of each curtain wall unit is for air and occupies a major portion of the side frame member, and wherein the second passageway in each side frame member is for a heat transfer medium and lies interiorly of the first passageway in side-by-side relation to one of the first pair of opposed grooves.

* * * * *